US006189622B1

(12) United States Patent
Audet et al.

(10) Patent No.: US 6,189,622 B1
(45) Date of Patent: Feb. 20, 2001

(54) NOZZLE FOR FIGHTING FIRES IN BUILDINGS

(75) Inventors: Clément Audet, Sainte-Foy; Richard Boivin, Candiac, both of (CA)

(73) Assignee: Le Group-Conseil LaSalle, Inc. (CA)

( * ) Notice: Under 35 U.S.C. 154(b), the term of this patent shall be extended for 0 days.

(21) Appl. No.: 09/309,512

(22) Filed: May 11, 1999

(51) Int. Cl.[7] ..... A62C 37/08
(52) U.S. Cl. ..... 169/37; 169/16; 239/251
(58) Field of Search ..... 239/225.1, 237, 239/246, 248, 251, 261, 543, 545, 548, 550, 556–559, 601, DIG. 1; 169/5, 37, 16

(56) References Cited

U.S. PATENT DOCUMENTS

| | | | | |
|---|---|---|---|---|
| 903,788 | * | 11/1908 | Schmidt | 239/251 |
| 2,466,182 | * | 4/1949 | Peeps | 239/559 |
| 2,607,625 | * | 8/1952 | Salmonese | 239/251 |
| 2,647,800 | * | 8/1953 | Burnam et al. | 169/37 |
| 4,043,397 | | 8/1977 | Glowienke . | |
| 4,106,702 | | 8/1978 | Gardner et al. . | |
| 4,568,025 | | 2/1986 | McLoud . | |
| 4,597,528 | | 7/1986 | Caruana . | |
| 4,610,310 | | 9/1986 | Miller et al. . | |
| 4,676,267 | | 6/1987 | Bloch . | |
| 4,687,024 | | 8/1987 | McMath . | |
| 4,700,894 | | 10/1987 | Grzych . | |
| 4,760,959 | | 8/1988 | Gorney . | |
| 4,793,557 | | 12/1988 | Marchese et al. . | |
| 4,841,999 | | 6/1989 | Danko . | |
| 4,850,538 | | 7/1989 | Krahn . | |
| 5,505,383 | | 4/1996 | Fischer . | |
| 5,803,363 | | 9/1998 | Marsumura et al. . | |

FOREIGN PATENT DOCUMENTS

| | | |
|---|---|---|
| 0 100 854 A1 | 2/1984 | (EP) . |

* cited by examiner

*Primary Examiner*—Andres Kashnikow
*Assistant Examiner*—Lisa Ann Douglas
(74) *Attorney, Agent, or Firm*—Merek & Voorhees

(57) ABSTRACT

A firefighting nozzle that will generate a spray of water in a 360° three-dimensional pattern, giving off a big sphere of fine droplets of water is disclosed herein. The nozzle has a hollow spherical portion rotatably mounted to the end of a rigid tube. Apertures are formed in such a pattern that an efficient mist production is achieved. Furthermore, some of the apertures are provided at such an angle that the water jets exiting these apertures exert a torque sufficient to rotate the nozzle with respect to the rigid tube to which it is mounted. The nozzle may be mounted to the end of a hand carried rigid tube or to the end of an articulated arm of a firefighting truck.

20 Claims, 4 Drawing Sheets

NOZZLE FOR FIGHTING FIRES IN BUILDINGS

FIELD OF THE INVENTION

The present invention relates to firefighting equipment. More specifically, the present invention relates to an improved nozzle capable of delivering a huge quantity of water, in a fine spray, directly inside a blazing building.

BACKGROUND OF THE INVENTION

Firemen risk their lives fighting the blaze, often with questionable success. At the high end of a truck-mounted ladder, when a fireman aims a conventional nozzle at a blaze, he can hardly see the blaze because of the thick black smoke coming out of the building. The conventional nozzle, which is so mounted to the ladder as to swivel therefrom, is aimed at the blaze by the fireman and can deliver a huge flow of water. The water jet must be dense since it must span the safe distance to be kept between the fireman and the blaze and must reach the building opening the fireman is aiming at.

Unfortunately, most of the water from the jet usually bounce on a wall opposite the opening or on the ceiling and come right back down, in the basement, through a staircase or an elevator shaft. This is unfortunate since the water that does not contact the portions of the building that are burning does not contribute to the extinguishing of the fire.

Other firemen of the same squad, at the same time, are likely to try to approach the blazing building at ground level. They use hand-held nozzles, necessarily much less powerful because of the recoil created by the ejected jet of water, but more efficient, up to a certain point, because their stream can be manually adjusted so as to deliver a larger spread of fine droplets. But one cannot easily come close to a blazing building without taking serious risks: objects, even walls, can fall on the firemen, or at other moments they can get choked by the smoke.

In either case, the tools the firefighters are conventionally using are not particularly well suited to achieve what is expected from them.

An improvement in firefighting nozzles has been brought forward by Leo J. Grzych in his U.S. Pat. No. 4,700,894 issued on Oct. 20, 1987. In this document, Grzych describes a fire nozzle forming a generally sphere-like water spray pattern. Grzych's fire nozzle assembly presents many drawbacks. First, it is formed of many mechanical pieces that are complicated, and therefore costly, to make. Furthermore, since there is no movement of the water jets created by the nozzle, problems arise should some of the apertures become clogged by foreign matter. Indeed, should that be the case, the sphere-like water spray pattern would be altered and some portions of the room would not get any water.

OBJECTS OF THE INVENTION

An object of the present invention is therefore to provide an improved nozzle, for fighting fires in buildings, free of the above-noted drawbacks of the prior art.

SUMMARY OF THE INVENTION

More specifically, in accordance with the present invention, there is provided a nozzle for fighting fires configured to be mounted to the end of a rigid tube; the nozzle comprising:

a rotatable coupling assembly including a fixed element to be mounted to the end of the rigid tube and a rotatable sub-assembly so mounted to the fixed element as to rotate about a rotation axis generally aligned with the rigid tube; the rotatable sub-assembly including a nozzle head receiving element provided with an opening coaxial with the rotation axis;

a nozzle head mounted to the nozzle head receiving element of the rotatable coupling assembly; the nozzle head having a hollow generally spherical portion defining an inner surface and an inlet open to the rigid tube; the spherical portion having a) at least two torque generating jet apertures formed therein at an angle and b) at least two colliding jet apertures;

wherein when water pressure is applied to the rigid tube i) at least two torque generating jets exit the nozzle head at an angle to induce a rotational movement of the nozzle head about the rotation axis, ii) at least two colliding jets exit the nozzle, iii) each colliding jet collides with a corresponding torque generating jet to divide each torque generating jet into a plurality of smaller jets.

According to another aspect of the present invention, there is provided a nozzle for fighting fires configured to be mounted to the end of a rigid tube; the nozzle comprising:

a rotatable coupling assembly so mounted to the end of the rigid tube as to rotate about a rotation axis generally aligned with the rigid tube; the rotatable coupling including a nozzle head receiving element provided with an opening coaxial with the rotation axis;

a nozzle head mounted to the nozzle head receiving element of the rotatable coupling assembly; the nozzle head having a hollow generally spherical portion defining an inner surface and an inlet open to the rigid tube; the spherical portion having a) at least two torque generating jet apertures formed therein at an angle each generating, when water pressure is applied, torque generating jets at an angle to induce a rotational movement of the nozzle head about the rotation axis, and b) at least two colliding jet apertures; each colliding aperture being so positioned as to generate, when water pressure is applied, a colliding jet that collides with a corresponding torque generating jet to divide each torque generating jet into a plurality of smaller jets.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

The general concept of the present invention is to provide a fire fighting instrument that can bring onto the blaze a huge stream of water that would be, by heat transfer, very quickly converted to water vapor. This quick conversion from water to vapor would expel all available air that would, otherwise, be used to sustain the combustion, and cool both the blazing material and the inflammable vapors released by other combustible materials that had reached, or were about to reach, their flash point.

It has been found that the above general concept of the present invention may be obtained by providing a nozzle that can generate a spray of very fine droplets of water, this over 360° in a three-dimension pattern, with a reach great enough to fill efficiently a very large room.

While it is an advantageous feature to provide a nozzle that may be configured and sized to be mounted to the end of an articulated arm of a firefighting truck, the present invention relates only to the nozzle, a truck-mounted articulated arm being already a conventional piece of equipment used extensively for many purposes.

Figure 1:
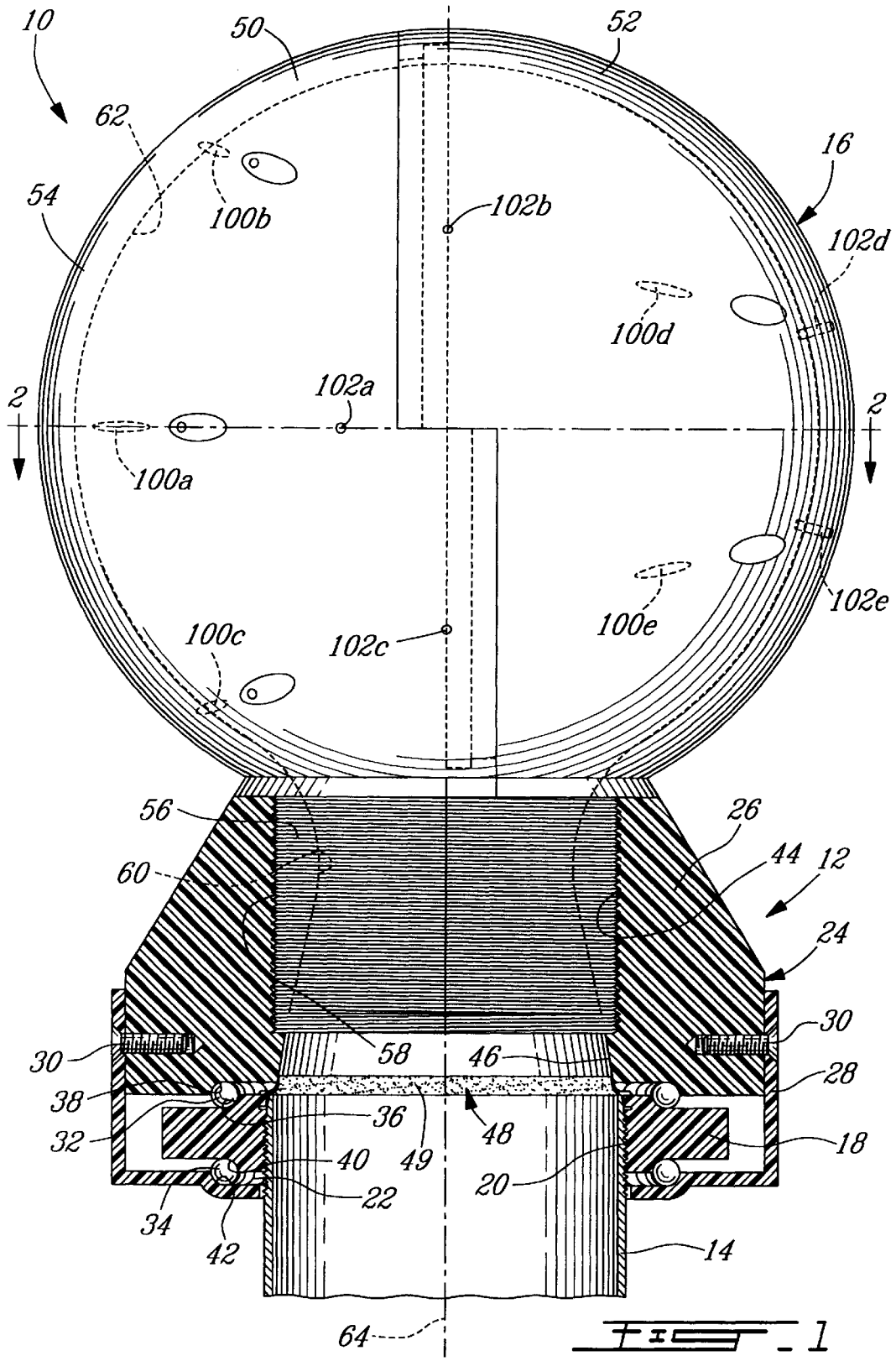
FIG. 1 is a sectional side elevational view of a nozzle according to an embodiment of the present invention.
Figure 2:
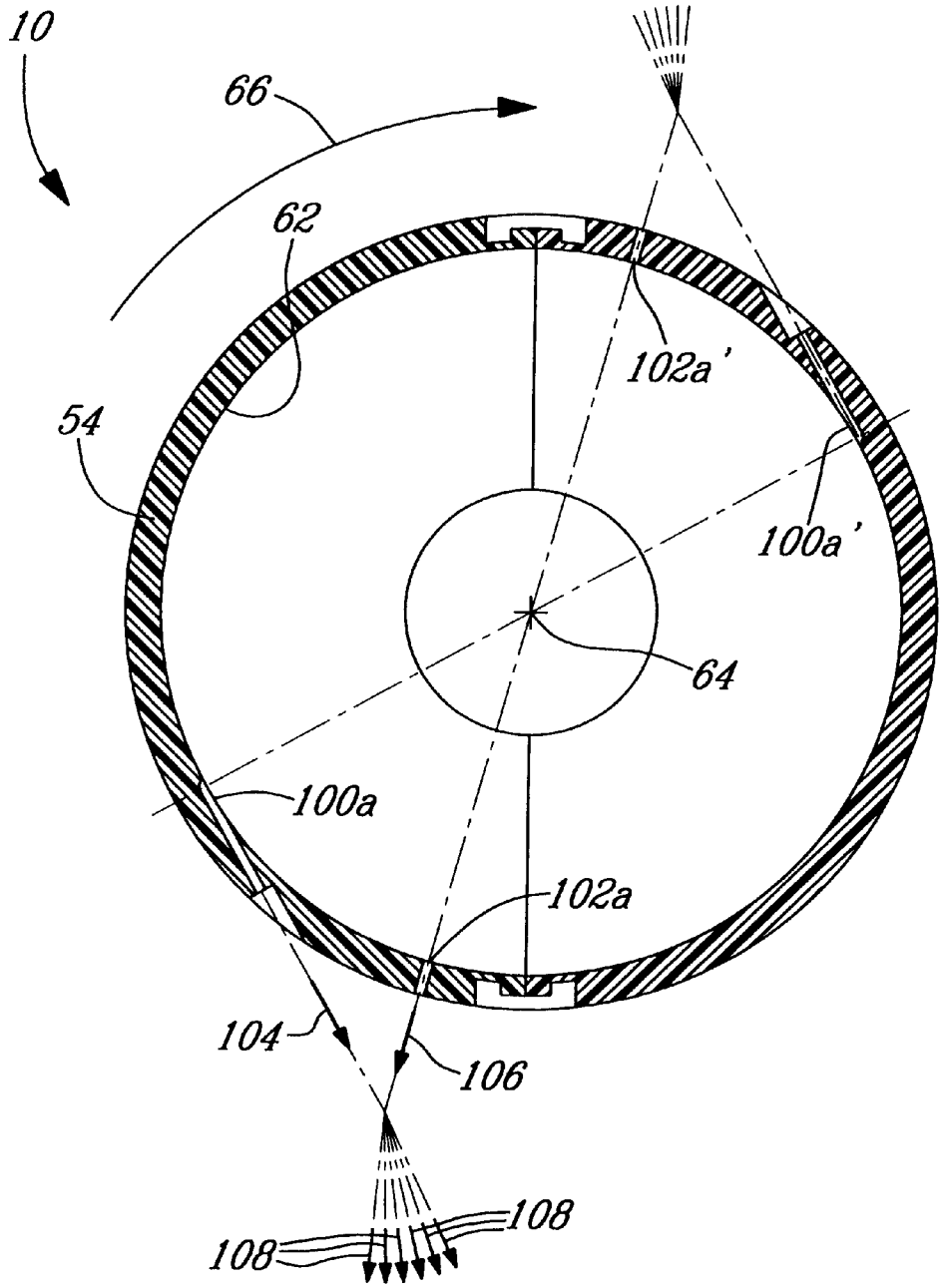
FIG. 2 is a sectional view taken along line 2—2 of FIG. 1.
Figure 3:
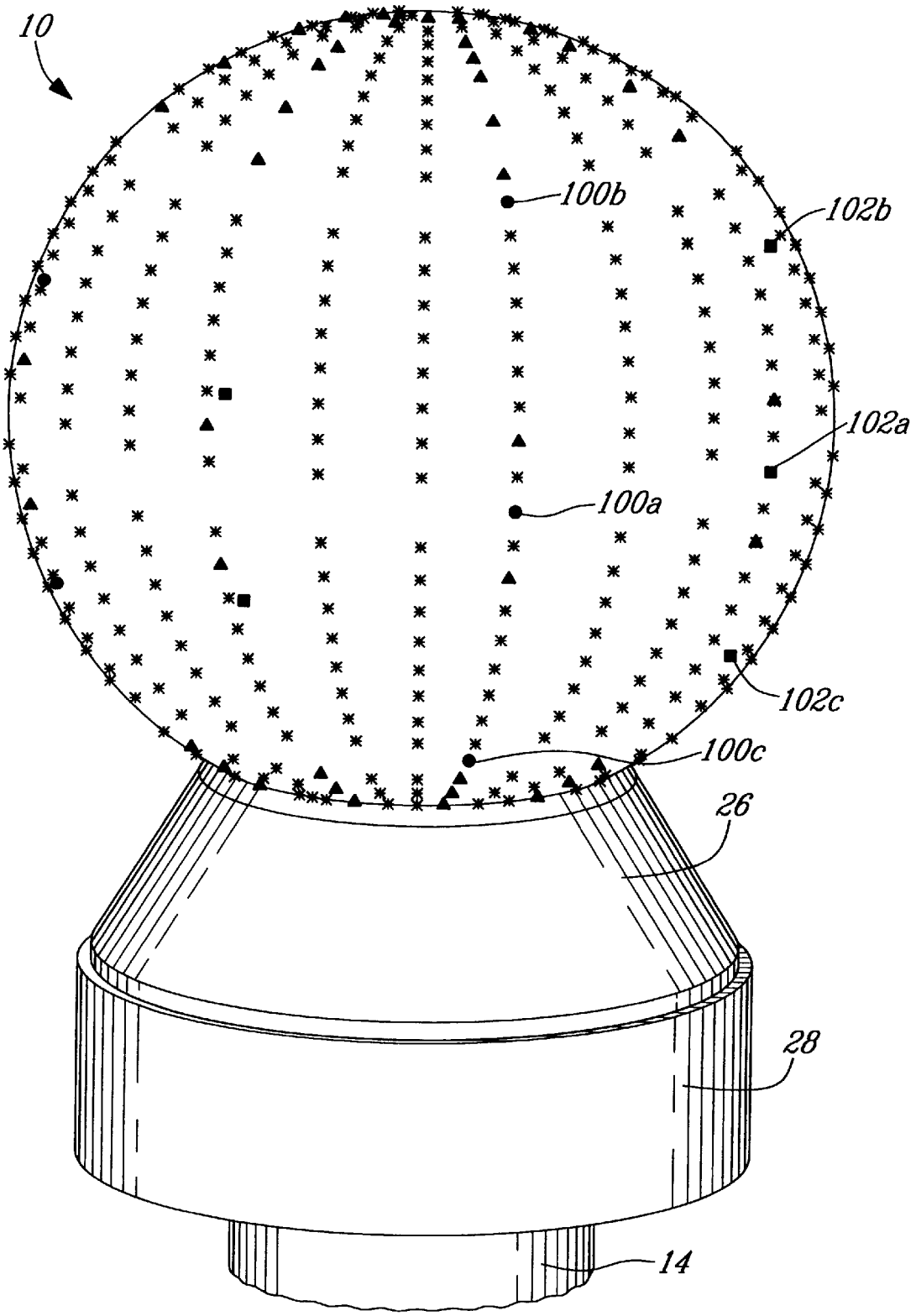
FIG. 3 is a schematic perspective view of the nozzle of FIG. 1 where four types of openings are schematically provided.

Turning now to FIGS. 1 to 3 of the appended drawings, a nozzle 10 according to an embodiment of the present invention will be described.

The nozzle 10 includes a rotatable coupling assembly 12, configured and sized to be mounted to the end of a rigid tube 14, and a nozzle head 16 removably mounted to the rotatable coupling assembly 12.

The rotatable coupling assembly 12 includes a fixed toroidal element 18 provided with internal threads 20 allowing it to be screwed onto external threads 22 of the tube 14. A rotatable sub-assembly 24 of the coupling assembly 12 includes a nozzle head receiving element 26 and a peripheral element 28 configured and sized to be mounted to the head receiving element 26 via fasteners 30.

The rotatable sub-assembly 24 is mounted to the fixed toroidal element 18 via first and second sets of ball bearings 32 and 34. More specifically, the first set of ball bearings 32 is provided peripherally between a concave portion 36 of the fixed element 18 and a concave portion 38 of the head receiving element 26; and the second set of ball bearings 34 is provided peripherally between a concave portion 40 of the fixed element 18 and a concave portion 42 of the peripheral element 28.

Of course, the purpose of the ball bearings 32 and 34 is to decrease the friction between the tube 14 and the nozzle 10 to thereby decrease the force required to rotate the nozzle 10. It is to be noted that other friction reducing means could be used.

As can be seen in FIG. 1, the nozzle head receiving element 26 includes a central cylindrical aperture having an internally threaded portion 44 and a taper portion 46. A seal gasket 48 is provided between the element 26 and the end of the tube 14 to prevent water from leaking therebetween. The seal gasket 48 includes a peripheral lip 49 that is in contact with the taper portion 46. As will be apparent to one skilled in the art, the water pressure will adequately seal the lip 49 to the taper portion 46. The gasket 48 is advantageously made of nylon which is a wear resistant sealing material.

It is to be noted that should the ball bearings 32 and 34 be water lubricated, the gasket 48 would not be required, but a gasket (not shown) would be required between the tube 14 and the peripheral element 28 thereby allowing water to lubricate the ball bearings.

The nozzle head 16 is made of two identical half-shells 50 and 52 that may be assembled using fasteners (not shown) or adhesives (not shown). Of course, the nozzle head 16 could be made of a single element.

When assembled, the half-shells 50 and 52 define the nozzle head 16 having a generally spherical nozzle portion 54 and an integral generally cylindrical mounting portion 56.

The mounting portion 56 is provided with a threaded external surface 58 configured and sized to cooperate with the internally threaded surface 44 of the nozzle head receiving element 26 to thereby mount the nozzle head 16 to the rotatable coupling assembly 12. The internal surface 60 of the mounting portion 56 defines a converging-diverging water passage between the rigid tube 14 and the spherical nozzle portion 54 to help distribute a more even pressure of the incoming water within the spherical nozzle portion 54.

It is to be noted that the slope of the converging portion of the internal surface 60 is similar to the slope of the taper portion 46 of the head receiving element 26 to thereby prevent the flow of water to be interfered with.

The spherical nozzle portion 54 is hollow and is provided with a suitable thickness to withstand the important flow of water therein as will be described hereinafter. The nozzle portion 54 therefore has an internal surface 62.

The spherical nozzle portion 54 is provided with a plurality of apertures defining a plurality of water outlets. More specifically, the nozzle portion 54 is provided with four different types of apertures:

torque generating jet apertures;

colliding jet apertures;

spray carrying jet apertures; and spray generating jet apertures.

It is to be noted that, for clarity purposes, only the torque generating apertures and the colliding jet apertures are shown on FIG. 1. The other types of apertures will be further described hereinbelow with respect to FIG. 4.

The nozzle portion 54 is provided with ten (10) torque generating jet apertures (only five shown) 100*a*–100*e;* and ten (10) corresponding colliding jet apertures (only five shown) 102*a*–102*e*.

The relationship between the torque generating jet apertures 100 and the colliding jet apertures 102 is better seen from FIG. 2, which is a sectional view of FIG. 1 taken along the "equator" thereof.

As can be better seen from this Figure, the torque generating aperture 100*a,* and its diametrally opposite torque generating aperture 100*a*', are so formed in the nozzle 54 that they are tangent from the internal surface 62 of the nozzle 54. It is to be noted that the torque generating jet apertures 100 are countersunk from the outer surface. This feature facilitate the construction by providing a small flat surface where the small orifice of the torque generating aperture may be drilled. This feature also improves the hydraulic performances of the torque generating jets by ensuring flow separation from the boundaries when they leave the aperture. Indeed, the countersunk portion of the torque generating jet apertures 100 ensures that, while the torque generating jets are tangential to the inner surface 62, they are also perpendicular to their immediate outer surface.

It is also to be noted that the torque generating jet apertures could be so formed in the nozzle 54 as to define another angle, as long as this angle is adequate to generate jets that bring the nozzle head 16 in rotation when water pressure is applied.

The colliding jet apertures 102, on the other hand, are perpendicular to the internal surface 62 of the nozzle 54. They are so positioned that each waterjet leaving one of these apertures will forcefully collide with the torque generating jet leaving the corresponding torque generating aperture. In other terms, the axis of each colliding jet aperture intersect the axis of the corresponding torque generating jet aperture. Furthermore, the angle of collision between these two jets is about 45°. For example, the torque generating jet (see arrow 104) leaving aperture 100*a* is forcefully hit by the colliding jet (see arrow 106) leaving the colliding jet aperture 102*a,* resulting in a plurality of smaller jets (see arrows 108). Of course, the water jets are schematically illustrated in FIG. 2.

It is to be noted that the colliding jet apertures 102 could be so formed as to be at an angle with respect to the inner surface 62 of the spherical nozzle portion 54, as long as this angle is such that a) the colliding jets generated, when water pressure is applied, collide with corresponding torque generating jets and b) the colliding jets do not create a torque that opposes the torque generated by the torque generating jets.

The purpose of the torque generating jet apertures 100 is to generate strong tangentially directed jets to induce a rotational movement of the spherical nozzle portion 54 about a rotation axis 64 (see arrow 66) when water pressure is applied to the nozzle 10 via the tube 14. Indeed, since all the torque generating apertures 100 generate water jets having a component that is parallel with the "equator", a torque is produced and rotation of the spherical nozzle portion 54 about axis 64 occurs.

However, for the present application, strong and far reaching jets, such as the torque generating jets describe hereinabove, are not particularly desirable. Therefore, each tangentially directed jet from one of the torque generating jet apertures 100 is forcefully hit by an equally strong, radially directed jet from one of the colliding jet apertures 102. The result of each one of those pairs of 45° colliding jets is a generally delta-shaped water spray that will add to the spray given off by the other radially perforated apertures, as will be described hereinbelow.

The rotational movement of the spherical nozzle portion 54 about a rotation axis 64 further contributes to the peripheral distribution of the spray. Also, should some apertures become clogged by foreign matter, the rotation of the nozzle portion 54 will ensure that water is evenly distributed throughout the room.

Turning now to FIG. 3 of the appended drawings, which is a schematic perspective view, the position of the four types of apertures of the spherical nozzle portion 54 will be described.

As described hereinabove, the first type of apertures is referred to as torque generating jets apertures 100. These apertures appear as circles (●) in FIG. 3. The diameter of these apertures is about 0,12 inches (about 0.003 meters), while the diameter of the countersunk portion of these apertures is about 0,25 inches (about 0,006 meters).

The positions of the various apertures of the spherical nozzle portion 54 will be given hereinbelow with respect to their latitude and longitude. The reference aperture is the aperture 100*a,* which is considered to be at a latitude of 0° and a longitude of 0°. It is also to be noted that the position of the apertures will be given with respect to the internal surface 62 of the spherical nozzle portion 54.

The following table 1 gives the position of the ten (10) torque generating jet apertures.

TABLE 1

Position of the torque generating jet apertures

| Latitude (XX° XX') | | | Longitude (YY° YY') | | |
|---|---|---|---|---|---|
| | 00 | 00 | | 00 | 00 |
| N | 45 | 00 | | 00 | 00 |
| S | 45 | 00 | | 00 | 00 |

TABLE 1-continued

Position of the torque generating jet apertures

| Latitude (XX° XX') | | | Longitude (YY° YY') | | |
|---|---|---|---|---|---|
| N | 22 | 30 | E | 90 | 00 |
| S | 22 | 30 | E | 90 | 00 |
| | 00 | 00 | | 180 | 00 |
| N | 45 | 00 | | 180 | 00 |
| S | 45 | 00 | | 180 | 00 |
| N | 22 | 30 | W | 90 | 00 |
| S | 22 | 30 | W | 90 | 00 |

As described hereinabove, the second type of apertures is referred to as colliding jets apertures. These apertures appear as squares (■) in FIG. 3. The diameter of these apertures is about 0.12 inches (about 0,003 meters).

As mentioned above, each one of the colliding jets will collide at a 45° angle with a corresponding torque generating jet discharging at approximately the same rate; the resultant will be a fan-shaped spray pattern, extending away from the sphere and in a plane perpendicular to the one containing the two colliding jets.

The following table 2 gives the position of the ten (10) colliding jet apertures.

TABLE 2

Position of the colliding jets

| Latitude (XX° XX') | | | Longitude (YY° YY') | | |
|---|---|---|---|---|---|
| | 00 | 00 | E | 45 | 00 |
| N | 30 | 00 | E | 54 | 45 |
| S | 30 | 00 | E | 54 | 45 |
| N | 15 | 43 | E | 137 | 15 |
| S | 15 | 43 | E | 137 | 15 |
| | 00 | 00 | W | 135 | 00 |
| N | 30 | 00 | W | 125 | 15 |
| S | 30 | 00 | W | 125 | 15 |
| N | 15 | 43 | W | 42 | 45 |
| S | 15 | 43 | W | 42 | 45 |

The third type of aperture is referred to as a spray carrying jet aperture. The purpose of these apertures is to generate relatively strong jets of water which will carry over the sprays generated by the collision of the torque generating jets and the colliding jets and the spray generated by the spray jets, to make them span a greater distance.

The spray carrying jet apertures appear as triangles (▲) in FIG. 3. The diameter of these apertures is about 0,08 inches (about 0,002 meters).

It is to be noted that the carrying apertures are mainly concentrated near the "poles" of the spherical nozzle portion 54 while the other relatively strong jets, i.e., torque generating jets and colliding jets, are more towards the "equator" of nozzle 54.

The following table 3 gives the position of the eighty one (81) carrying jet apertures.

TABLE 3

Position of the carrying jet apertures

| Latitude (XX° XX') | | | Longitude (YY° YY') |
|---|---|---|---|
| N | 90 | 00 | (north pole) |
| N | 85 | 00 | E 45 00; E 135 00; W 135 00; W 45 00 |
| N | 80 | 00 | 00 00; E 90 00; 180 00; W 90 00 |
| N | 75 | 00 | E 45 00; E 135 00; W 135 00; W 45 00 |

TABLE 3-continued

| Position of the carrying jet apertures | | | |
|---|---|---|---|
| Latitude (XX° XX') | | | Longitude (YY° YY') |
| N | 75 | 00 | 00 00; E 90 00; 180 00; W 90 00 |
| N | 70 | 00 | E 45 00; E 135 00; W 135 00; W 45 00 |
| N | 70 | 00 | 00 00; E 90 00; 180 00; W 90 00 |
| N | 60 | 00 | E 45 00; E 135 00; W 135 00; W 45 00 |
| N | 60 | 00 | 00 00; E 90 00; 180 00; W 90 00 |
| N | 50 | 00 | E 45 00; E 135 00; W 135 00; W 45 00 |
| N | 50 | 00 | 00 00; E 90 00; 180 00; W 90 00 |
| N | 10 | 00 | E 45 00; E 135 00; W 135 00; W 45 00 |
| N | 10 | 00 | 00 00; E 90 00; 180 00; W 90 00 |
| S | 10 | 00 | E 45 00; E 135 00; W 135 00; W 45 00 |
| S | 10 | 00 | 00 00; E 90 00; 180 00; W 90 00 |
| S | 50 | 00 | E 45 00; E 135 00; W 135 00; W 45 00 |
| S | 50 | 00 | 00 00; E 90 00; 180 00; W 90 00 |
| S | 55 | 00 | E 45 00; E 135 00; W 135 00; W 45 00 |
| S | 55 | 00 | 00 00; E 90 00; 180 00; W 90 00 |
| S | 60 | 00 | E 45 00; E 135 00; W 135 00; W 45 00 |
| S | 60 | 00 | 00 00; E 90 00; 180 00; W 90 00 |

The fourth and final type of aperture is referred to as a spray generating jet aperture. The purpose of these numerous apertures is to generate a plurality of spray generating jets made of fine droplets of water to form a mist about the nozzle 10. As mentioned hereinabove, portion of this mist is carried by the carrying jets, to make them span a greater distance.

The spray generating jet apertures appear as asterisks (*) in FIG. 3. The diameter of these apertures is about 0,04 inches (about 0,001 meters).

The following table (table 4) positions the spray generating jet apertures onto the inner surface 62 of the spherical nozzle portion 54. It is to be noted that, for concision purposes, only the apertures provided in the first quadrant (from longitude 0° to longitude 89° ) is included in table 4. It is believed within the reach of one skilled in the art to reproduce this first quadrant in the other quadrants.

TABLE 4

| Position of the spray generating jets | | | |
|---|---|---|---|
| Latitude (XX° XX') | | | Longitude (YY°) |
| N | 87 | 30 | 00; E 45 |
| N | 85 | 00 | E 15; E 30; E 60; E 75 |
| N | 80 | 00 | E 15; E 30; E 60; E 75 |
| N | 75 | 00 | E 15; E 30; E 60; E 75 |
| N | 70 | 00 | E 15; E 30; E 60; E 75 |
| N | 65 | 00 | E 15; E 30; E 60; E 75 |
| N | 60 | 00 | E 15; E 30; E 60; E 75 |
| N | 55 | 00 | E 15; E 30; E 60; E 75 |
| N | 50 | 00 | E 15; E 30; E 60; E 75 |
| N | 40 | 00 | 00; E 15; E 30; E 45; E 60; E 75 |
| N | 35 | 00 | 00; E 15; E 30; E 45; E 60; E 75 |
| N | 30 | 00 | 00; E 15; E 30; E 45; E 60; E 75 |
| N | 25 | 00 | 00; E 15; E 30; E 45; E 60; E 75 |
| N | 20 | 00 | 00; E 15; E 30; E 45; E 60; E 75 |
| N | 15 | 00 | 00; E 15; E 30; E 45; E 60; E 75 |
| N | 10 | 00 | 00; E 15; E 30; E 45; E 60; E 75 |
| N | 5 | 00 | 00; E 15; E 30; E 45; E 60; E 75 |
| S | 5 | 00 | 00; E 15; E 30; E 45; E 60; E 75 |
| S | 10 | 00 | 00; E 15; E 30; E 45; E 60; E 75 |
| S | 15 | 00 | 00; E 15; E 30; E 45; E 60; E 75 |
| S | 20 | 00 | 00; E 15; E 30; E 45; E 60; E 75 |
| S | 25 | 00 | 00; E 15; E 30; E 45; E 60; E 75 |
| S | 30 | 00 | 00; E 15; E 30; E 45; E 60; E 75 |
| S | 35 | 00 | 00; E 15; E 30; E 45; E 60; E 75 |
| S | 40 | 00 | 00; E 15; E 30; E 45; E 60; E 75 |
| S | 50 | 00 | E 15; E 30; E 60; E 75 |

TABLE 4-continued

| Position of the spray generating jets | | | |
|---|---|---|---|
| Latitude (XX° XX') | | | Longitude (YY°) |
| S | 55 | 00 | E 15; E 30; E 60; E 75 |
| S | 60 | 00 | E 15; E 30; E 60; E 75 |

It is to be noted that should any one of the spray generating apertures listed in table 4 interfere with one of the apertures listed in the first three tables, the spray generating aperture will give way.

The rated capacity of the nozzle 10 of the present invention, that is the rate of flow of the water to be spread over a fire, must be suited to various needs. It is therefore obvious that the diameter of the feeding pipe and the diameter of the sphere, as well as the number of apertures, their diameter and their pattern, have to be designed accordingly and these are variables that affect this invention. Consequently, it will be appreciated by one skilled in the art that numerous changes and modifications can be made to the nozzle 10 illustrated in FIGS. 1–3 without departing from the spirit and nature of the present invention.

Figure 4:
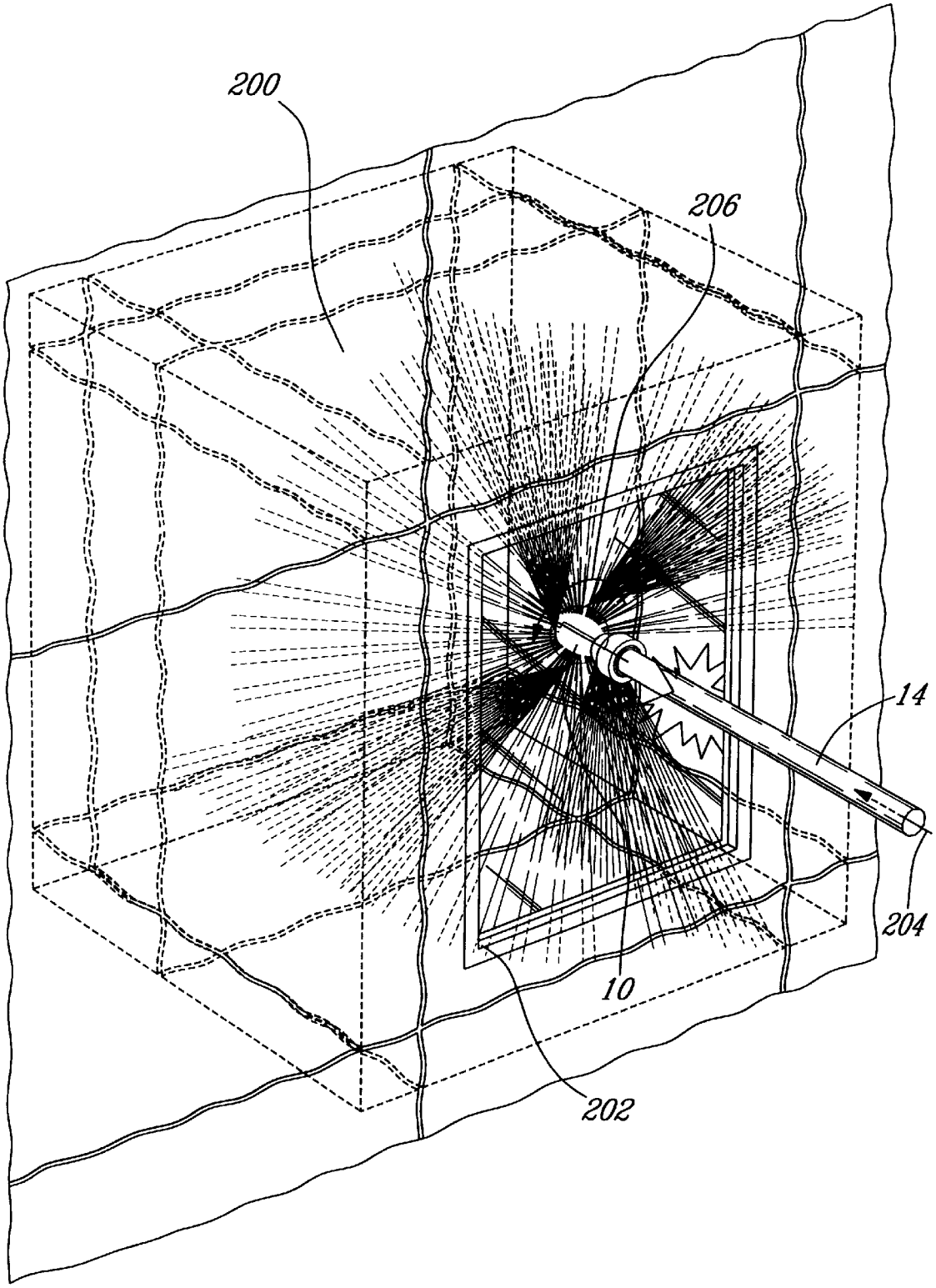
FIG. 4 is a perspective view illustrating the nozzle of FIG. 1 mounted at the end of a rigid tube and introduced in a room through a window.

Turning now our attention to FIG. 4 of the appended drawings, which illustrates the nozzle 10 mounted to the tube 14, the general operation of the nozzle 10 will be described.

The nozzle 10 is shown introduced in a room 200 via a window 202.

The water coming from the tube 14 (see arrow 204) forcefully leaves the nozzle 10 via the plurality of apertures. The torque generating jets cause the rotation of the rotatable portion of the nozzle (see arrow 206). This rotation will cause a generally equal amount of water to reach the four walls, the ceiling and the floor.

It is to be noted that the tube 14 is advantageously the last and upper linkage of an articulated arm. Of course, the tube 14 could also be hand held by a fireman.

It is also to be noted that the nozzle 10 of the present invention could also be used to spray a fire extinguishing foam.

Although the present invention has been described hereinabove by way of preferred embodiments thereof, it can be modified, without departing from the spirit and nature of the subject invention as defined in the appended claims. As non-limiting examples, the nozzle head 16 could be made of an integral piece or it could be fixedly mounted to the nozzle receiving element 26.

What is claimed is:

1. A nozzle for fighting fires configured to be mounted to the end of a rigid tube; said nozzle comprising:

a rotatable coupling assembly including a fixed element to be mounted to the end of the rigid tube and a rotatable sub-assembly so mounted to the fixed element as to rotate about a rotation axis generally aligned with the rigid tube; said rotatable sub-assembly including a nozzle head receiving element provided with an opening coaxial with said rotation axis;

a nozzle head mounted to the nozzle head receiving element of the rotatable coupling assembly; said nozzle head having a hollow generally spherical portion defining an inner surface and a generally cylindrical portion defining an inlet open to the rigid tube; said spherical portion having a) at least two torque generating jet apertures formed therein at an angle and b) at least two colliding jet apertures; said generally cylindrical portion defining a converging-diverging passage between the rigid tube and the generally cylindrical portion;

wherein, when water pressure is applied to said rigid tube i) at least two torque generating jets exit said nozzle head through said at least two torque generating jet apertures at an angle to induce a rotational movement of said nozzle head about said rotation axis, ii) at least two colliding jets exit said nozzle through said at least two colliding jet apertures, iii) each said at least two colliding jets collide with a corresponding one of said at least two torque generating jets to divide each said at least two torque generating jets into a plurality of smaller jets.

2. A nozzle as recited in claim 1, wherein said fixed element of said rotatable coupling assembly has a generally toroidal shape and includes internal threads configured and sized to cooperate with external threads of the rigid tube.

3. A nozzle as recited in claim 2, wherein said nozzle receiving element is mounted to said fixed element via friction reducing means.

4. A nozzle as recited in claim 3, wherein said rotatable coupling assembly further includes a peripheral element fixedly mounted to said nozzle receiving element and rotatably mounted to said fixed element via friction reducing means.

5. A nozzle as recited in claim 1, wherein said rotatable coupling assembly further includes a sealing element provided between the rigid tube and said nozzle receiving element.

6. A nozzle as recited in claim 1, wherein said opening of said nozzle receiving element is internally threaded, and wherein said generally cylindrical portion is provided with external threads configured and sized to cooperate with said internal threads of said nozzle receiving element, thereby allowing said nozzle head to be removably mounted to said nozzle receiving element.

7. A nozzle as recited in claim 1, wherein said nozzle head is formed of two identical half-shells.

8. A nozzle as recited in claim 1, wherein said generally spherical portion of said nozzle head further includes:

at least two spray generating jet apertures, each configured and sized to generate a fine spray of water when water pressure is applied; and at least two spray carrying jet apertures, each configured and sized to generate a spray carrying jet when water pressure is applied.

9. A nozzle as recited in claim 1, wherein each said at least two torque generating jet apertures is countersunk from an outer surface of said generally spherical portion of said nozzle head.

10. A nozzle as recited in claim 1, wherein each said at least two colliding jet apertures is so formed in said generally spherical portion as to be generally perpendicular to said inner surface.

11. A nozzle for fighting fires configured to be mounted to the end of a rigid tube; said nozzle comprising:

a rotatable coupling assembly so mounted to the end of the rigid tube as to rotate about a rotation axis generally aligned with the rigid tube; said rotatable coupling including a nozzle head receiving element provided with an opening coaxial with said rotation axis;

a nozzle head mounted to the nozzle head receiving element of the rotatable coupling assembly; said nozzle head having a hollow generally spherical portion defining an inner surface and a generally cylindrical portion defining an inlet open to the rigid tube; said generally cylindrical portion defining a converging-diverging passage between the rigid tube and the generally cylindrical portion; said spherical portion having a) at least two torque generating jet apertures formed therein at an angle each generating, when water pressure is applied, torque generating jets at an angle to induce a rotational movement of said nozzle head about said rotation axis, and b) at least two colliding jet apertures; each said at least two colliding jet apertures being so positioned as to generate, when water pressure is applied, a colliding jet that collides with a corresponding one of said at least two torque generating jets to divide each said at least two torque generating jets into a plurality of smaller jets.

12. A nozzle as recited in claim 11, wherein said opening of said nozzle receiving element is internally threaded, and wherein said generally cylindrical portion is provided with external threads configured and sized to cooperate with said internal threads of said nozzle receiving element, thereby allowing said nozzle head to be removably mounted to said nozzle receiving element.

13. A nozzle as recited in claim 11, wherein said rotatable coupling assembly includes a fixed element to be mounted to the end of the rigid tube; said fixed element having a generally toroidal shape and including internal threads configured and sized to cooperate with external threads of the rigid tube.

14. A nozzle as recited in claim 13, wherein said nozzle receiving element is rotatably mounted to said fixed element via friction reducing means.

15. A nozzle as recited in claim 14, wherein said rotatable coupling assembly further includes a peripheral element fixedly mounted to said nozzle receiving element and rotatably mounted to said fixed element via friction reducing means.

16. A nozzle as recited in claim 11, wherein said rotatable coupling assembly further includes a sealing element provided between the rigid tube and said nozzle receiving element.

17. A nozzle as recited in claim 11, wherein said nozzle head is formed of two identical half-shells.

18. A nozzle as recited in claim 11, wherein said generally spherical portion of said nozzle head further includes:

at least two spray generating jet apertures, each configured and sized to generate a fine spray of water when water pressure is applied; and at least two spray carrying jet apertures, each configured and sized to generate a spray carrying jet when water pressure is applied.

19. A nozzle as recited in claim 11, wherein each said torque generating jet aperture are countersunk from an outer surface of said generally spherical portion of said nozzle head.

20. A nozzle as recited in claim 11, wherein each said at least two colliding jet apertures is so formed in said generally spherical portion as to be generally perpendicular to said inner surface.

* * * * *